US005577350A

United States Patent [19]

Brisbin et al.

[11] Patent Number: 5,577,350

[45] Date of Patent: Nov. 26, 1996

[54] AUDITORIUM

[75] Inventors: Brian Brisbin; Felim McCaffrey; Peter Sheffield, all of Toronto, Canada

[73] Assignee: Musicdome Ventures, Inc., Encino, Calif.

[21] Appl. No.: 351,368

[22] PCT Filed: Jun. 10, 1993

[86] PCT No.: PCT/CA93/00237

§ 371 Date: Jun. 5, 1995

§ 102(e) Date: Jun. 5, 1995

[87] PCT Pub. No.: WO93/25777

PCT Pub. Date: Dec. 23, 1993

[30] Foreign Application Priority Data

Jun. 10, 1992 [GB] United Kingdom ..... 921281

[51] Int. Cl.[6] ..... E04B 7/16; E04H 3/12

[52] U.S. Cl. ..... 52/6; 52/66; 52/80.1

[58] Field of Search ..... 52/6, 8, 66, 73, 52/80.1, 81.2, 67, 72

[56] References Cited

U.S. PATENT DOCUMENTS

| | | | |
|---|---|---|---|
| 1,868,068 | 7/1932 | Moulton | 52/10 |
| 4,075,795 | 2/1978 | Thomas | 52/8 |
| 4,738,057 | 4/1988 | Logan | 52/6 X |
| 5,007,214 | 4/1991 | Itami et al. | 52/66 |
| 5,027,565 | 7/1991 | Sugizaki | 52/6 |
| 5,058,332 | 10/1991 | Masuyama et al. | 52/66 |
| 5,394,659 | 3/1995 | Kawaguchi et al. | 52/6 X |

FOREIGN PATENT DOCUMENTS

| | | | |
|---|---|---|---|
| 244213 | 11/1987 | European Pat. Off. . | |
| 2120395 | 8/1972 | France . | |
| 2645563 | 10/1990 | France . | |
| 2-308036 | 12/1990 | Japan | 52/80.1 |
| 3-115632 | 5/1991 | Japan | 52/66 |
| 3-147958 | 6/1991 | Japan | 52/66 |
| 4-24342 | 1/1992 | Japan | 52/66 |
| 2225360 | 5/1990 | United Kingdom . | |

OTHER PUBLICATIONS

Perrin, "Le dome de l'auditorium de Pittsburgh", Schweizerische Bauzeitung, vol. 49, No. 8, pp. 873–876 Dec. 1963.

"Retractable for All-Weather", Architectural Record, pp. 250–252 May 1959.

Giovine, "Moving Roof Covers Theater", Popular Science, pp. 130–131 Jun. 1951.

"Umbrella Theater", Popular Mechanics, pp. 132–133 May 1950.

*Primary Examiner*—Wynn E. Wood
*Assistant Examiner*—Laura A. Saladino
*Attorney, Agent, or Firm*—Blakely, Sokoloff, Taylor, Zafman

[57] ABSTRACT

An auditorium has a domed roof formed by a first part spherical portion covering, without intermediate support, most of an amphitheatre accommodating an audience, and a second part spherical portion covering a stage adjacent the amphitheatre, the first portion being supported only at its periphery, and the second portion consisting of segmental leaves which can open about a common pivot supported by the first portion to uncover the stage, the common pivot being at a vertical axis of the second portion of the roof and above the amphitheatre and the vertical axis of the first portion being above the stage. Wall panels behind the stage can be moved apart to open the rear of the stage to the exterior.

2 Claims, 6 Drawing Sheets

AUDITORIUM

This invention relates to auditoriums of the amphitheatre type as used for concerts, theatrical, cinematograph and other public presentations.

A problem in the presentation of such performances is that, where they are presented in different cities, available facilities may vary greatly in physical layout and capacity. This may require modification of the performance or alter the artistic impression provided. The available facilities may be ill suited to the size of the expected audience, and usually do not combine facilities for all-season usage with the potential for an outdoor ambience.

An object of the invention is to provide an amphitheatre type auditorium providing standardized but widely adaptable facilities, suitable for all-season, all weather use, and capable of providing the ambience of an outdoor performance.

It has previously been proposed to provide auditoriums of this type having roof portions in the form of rotatable segmental leaves over a stage area, as shown for example in British Published Patent Application No. 2225360A, particularly FIGS. 13 to 15 showing prior art structures. All such structures have required a central pillar, which is highly undesirable if an audience is to have an unobstructed view of the stage.

According to the invention, there is provided an auditorium, comprising an amphitheatre having a seating area only partially surrounding a stage, a first fixed roof structure covering a majority of the amphitheatre area except for a segmental area above the stage, and second movable roof structure of segmental form movable between a first position in which it closes said segmental area, and a second position lapping the first roof structure and leaving said segmental area open, said movable roof structure comprising segmental leaves rotatable in opposite directions about a common pivotal axis between a first closed position in which the leaves abut and a second open position in which they underlay the fixed roof structure, the first and second roof structures both being part-spherical shells, characterized in that the fixed roof structure is supported only at its periphery, and the movable roof structure is supported at its periphery and by a connection to the fixed roof structure on said common pivotal axis, in that a vertical axis of a first virtual sphere containing the shell forming the fixed roof structure passes through the stage, and in that a vertical axis of a second virtual sphere containing the shell forming the movable roof structure coincides with said common pivotal axis and is located horizontally spaced from the stage so as to intersect the seating area of the amphitheatre, intermediate between the vertical axis of the first virtual sphere and the periphery of the fixed roof structure. The auditorium may include means to partition off, by radially and/or cirumferentially extending partitions, portions of seating area to provide amphitheatres of different capacities. Retractable panels forming a curtain wall may be provided behind that portion of the stage not surrounded by the seating area.

The above arrangement provides an all weather auditorium of flexible capacity which nevertheless is capable of providing an open-air ambience under suitable weather conditions.

Further features of the invention will become apparent from the following description of a presently preferred embodiment of the invention with reference to the accompanying drawings in which.

Figure 1:
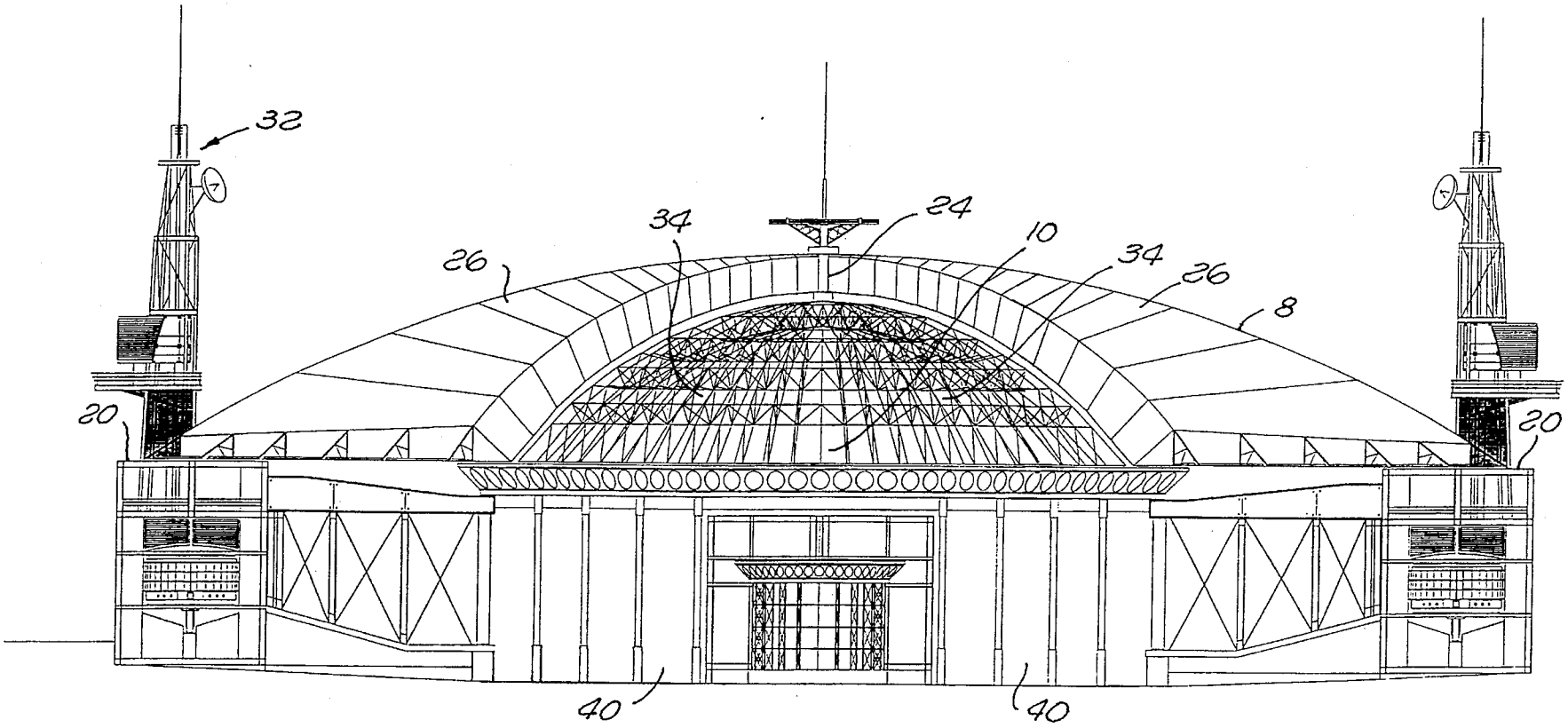
FIG. 1 is an elevation of the auditorium in accordance with the invention, facing the amphitheatre, with its roof closed and the wall behind its stage in place.

The auditorium shown in the drawings comprises the following principal components; a banked amphitheatre comprising a seating area having a main seating level 2 and a superposed gallery level 4, a stage 6, a fixed main roof 8, an opening auxiliary roof 10, a retractable curtain wall 12 behind the stage, and a foundation 14 supporting the amphitheatre, and curtain wall, supports 16 for the roofs, auxiliary structures 18 providing services such as restaurants, and service towers 20.

The main, fixed roof 8 comprises a part spherical shell supported solely at an approximately semicircular periphery 21, a virtual sphere containing the shell having a vertical spherical axis 7 above the stage 6, although that portion of the fixed roof above the stage is segmentally cut away along margins 22 converging at an axis 24, well spaced from the stage and over the seating area of the amphitheatre. Sloped transitional portions 26 extend between the margins 22 and lines 28 which extend from the axis 24 towards the ends of the periphery 21. The roof 8 is supported at its periphery by the amphitheatre structure and by the service towers 20 which provide housings for mechanical and other services for the building and elevators 30, as well as support for telecommunications equipment 32.

Figure 2:
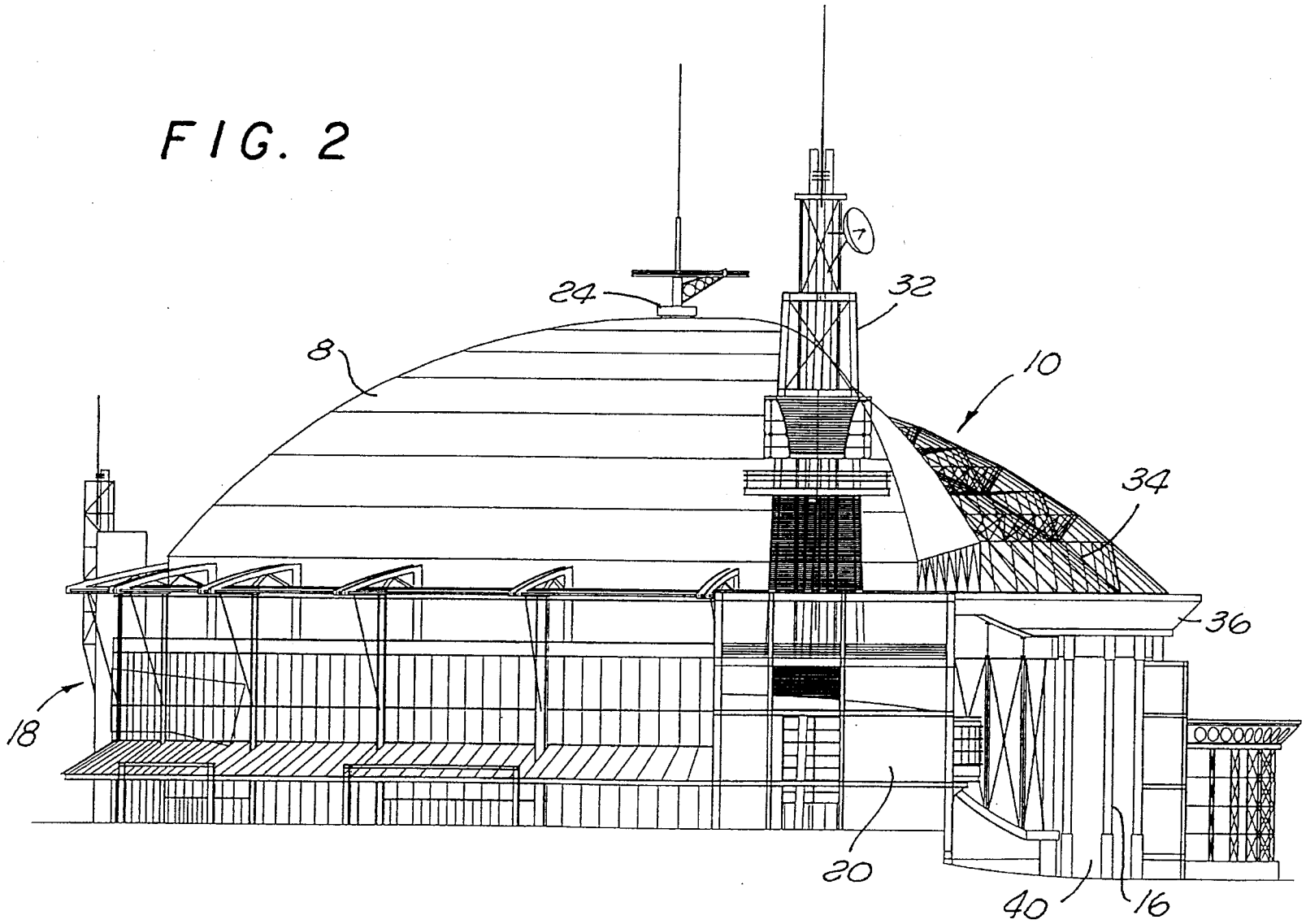
FIG. 2 is an end elevation of the auditorium.
Figure 3:
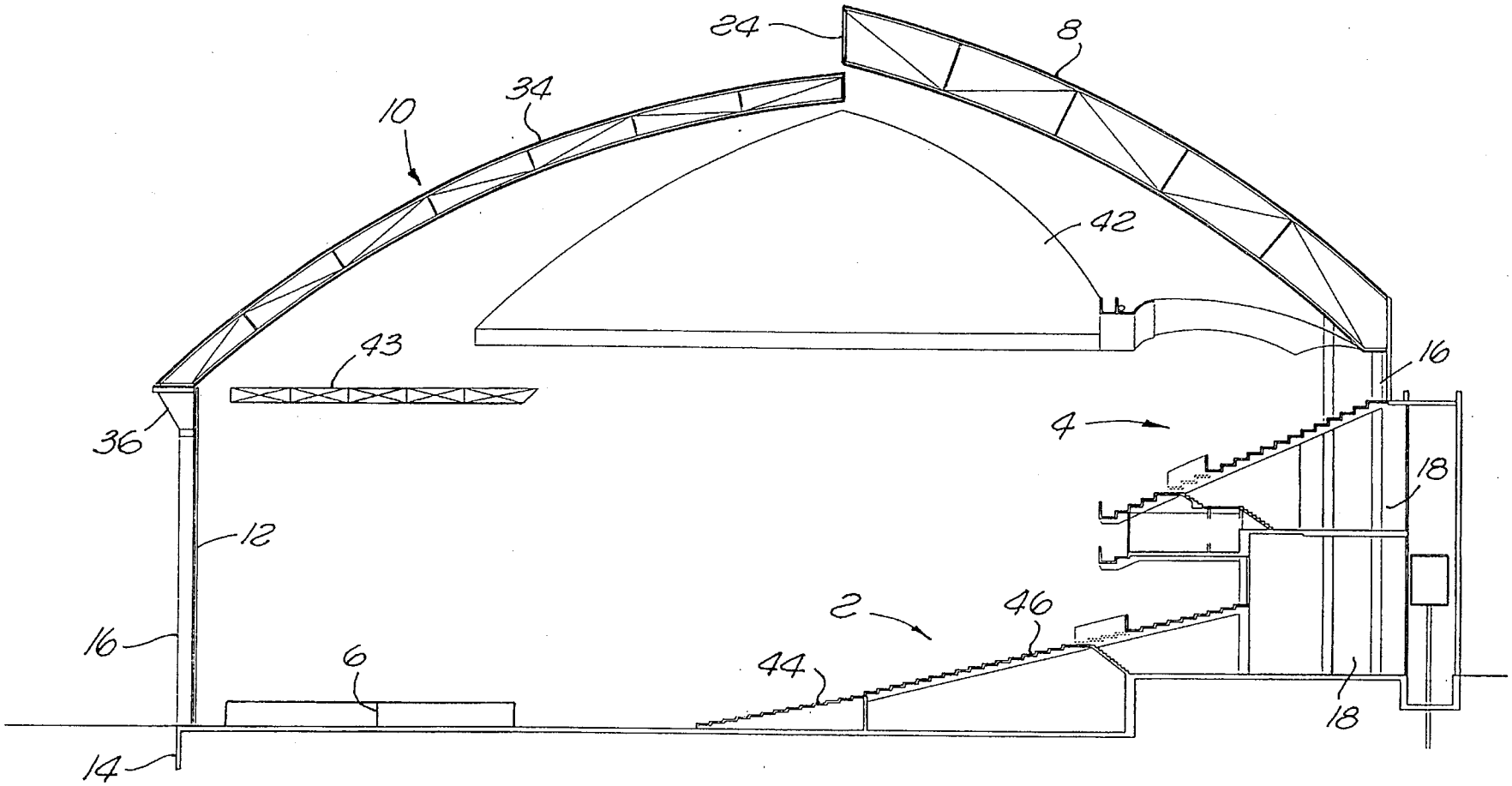
FIG. 3 is a vertical cross-section through the stage and amphitheatre.
Figure 4:
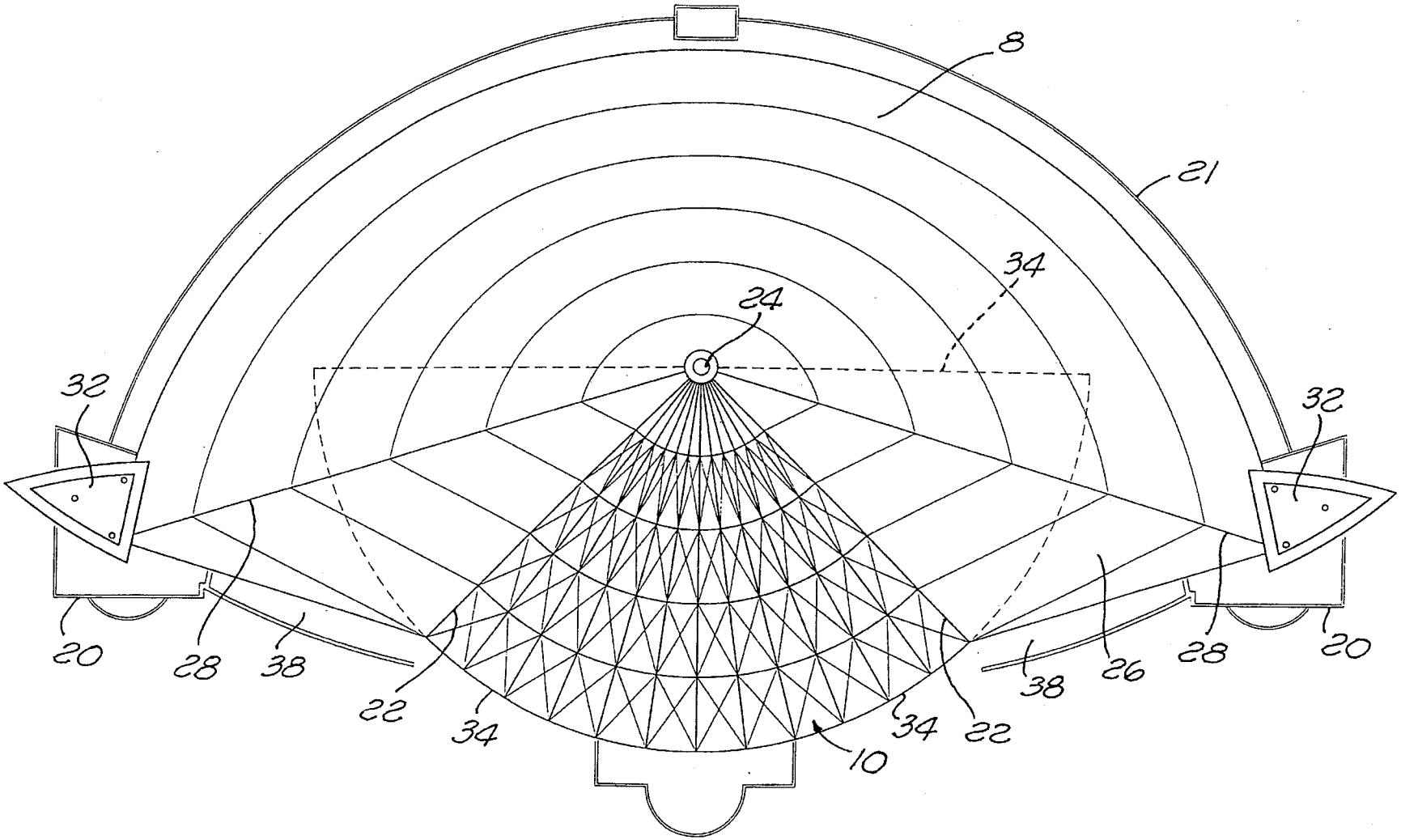
FIG. 4 is a plan view of the auditorium.
Figure 5:
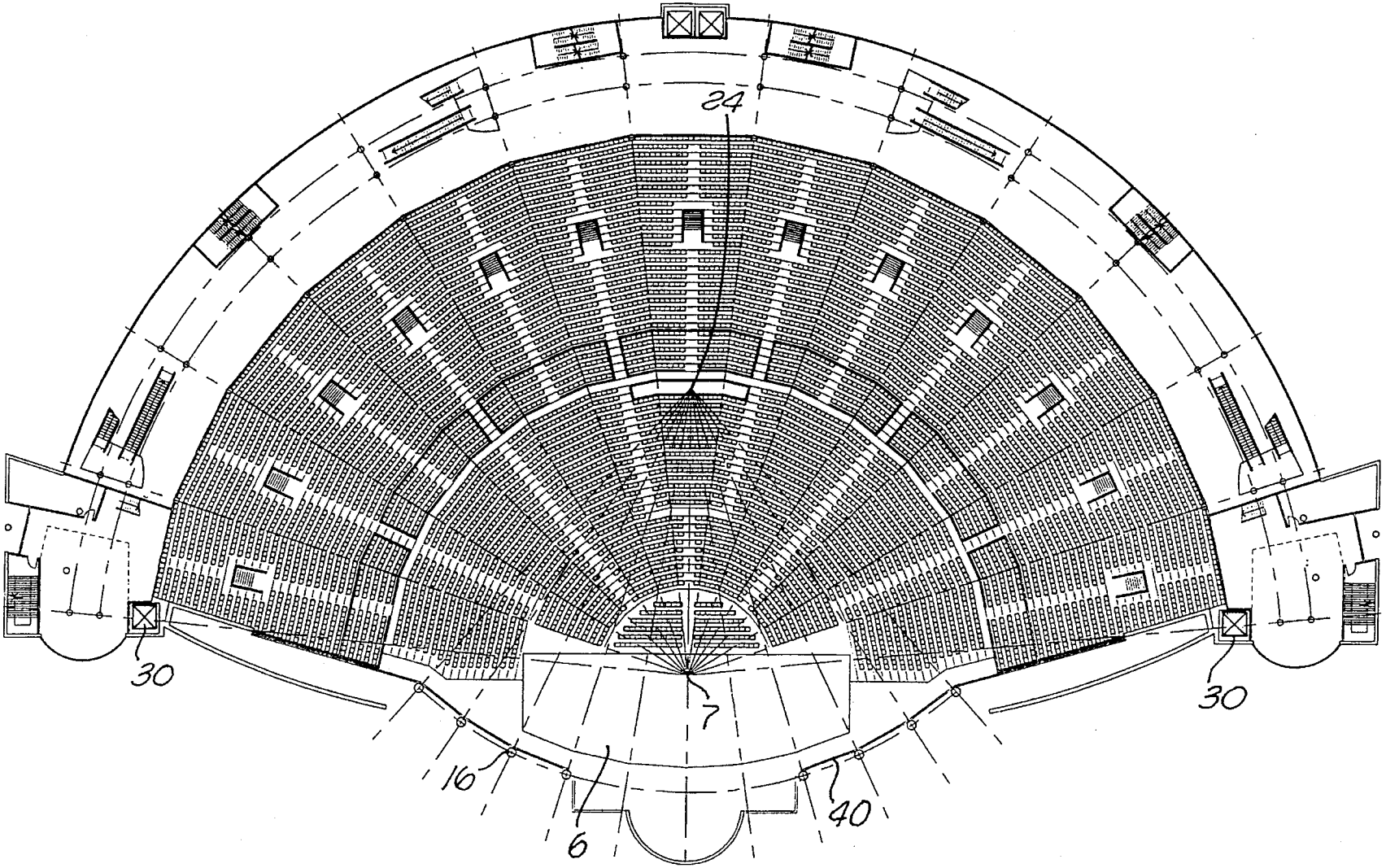
FIG. 5 is a plan view of a lower seating level in the auditorium.

The opening auxiliary roof 10 comprises two part-spherical segmental leaves 34 pivotally connected at their apices for rotation about the axis 24, which is the vertical axis of a virtual sphere containing the leaves, between a first, closed, position (see FIGS. 1 and 2 and the solid line depiction in FIG. 4) closing the segmental cutaway in the main roof defined by the margins 22 and a retracted position (see the broken line depiction in FIG. 4). The leaves 34 are supported at their outer peripheries by a track 36 carried by the supports 16 behind the stage 6. Since the greater portion of the roof structure is comprised by spherical shells, it can be constructed in modular fashion from rib components of only two different radii, thus simplifying construction. By situating the axis 24 which forms the common pivot point for the movable leaves 34 above the seating on level 2 and substantially spaced from the vertical axis of the shell forming the main roof 6 on the centre line of the amphitheatre a self-supporting structure can be provided, requiring no central pillar, and in which retraction of the leaves 34 will place the stage 6 in the open air and provide a substantial open air illusion to the auditorium as a whole, which can be greatly enhanced by withdrawing, into pockets 38, sliding panels 40 forming a curtain wall behind the stage 6. Deployment of the panels 40 and closing of the leaves 34 provides a wholly enclosed auditorium during inclement weather or to provide an enclosed environment. The lower surfaces of the leaves 34 may support baffles or reflectors for acoustic control purposes, as may the main roof structure 8, as shown at 42. A frame 43 may be supported above the stage to support lighting and other equipment.

Figure 6:
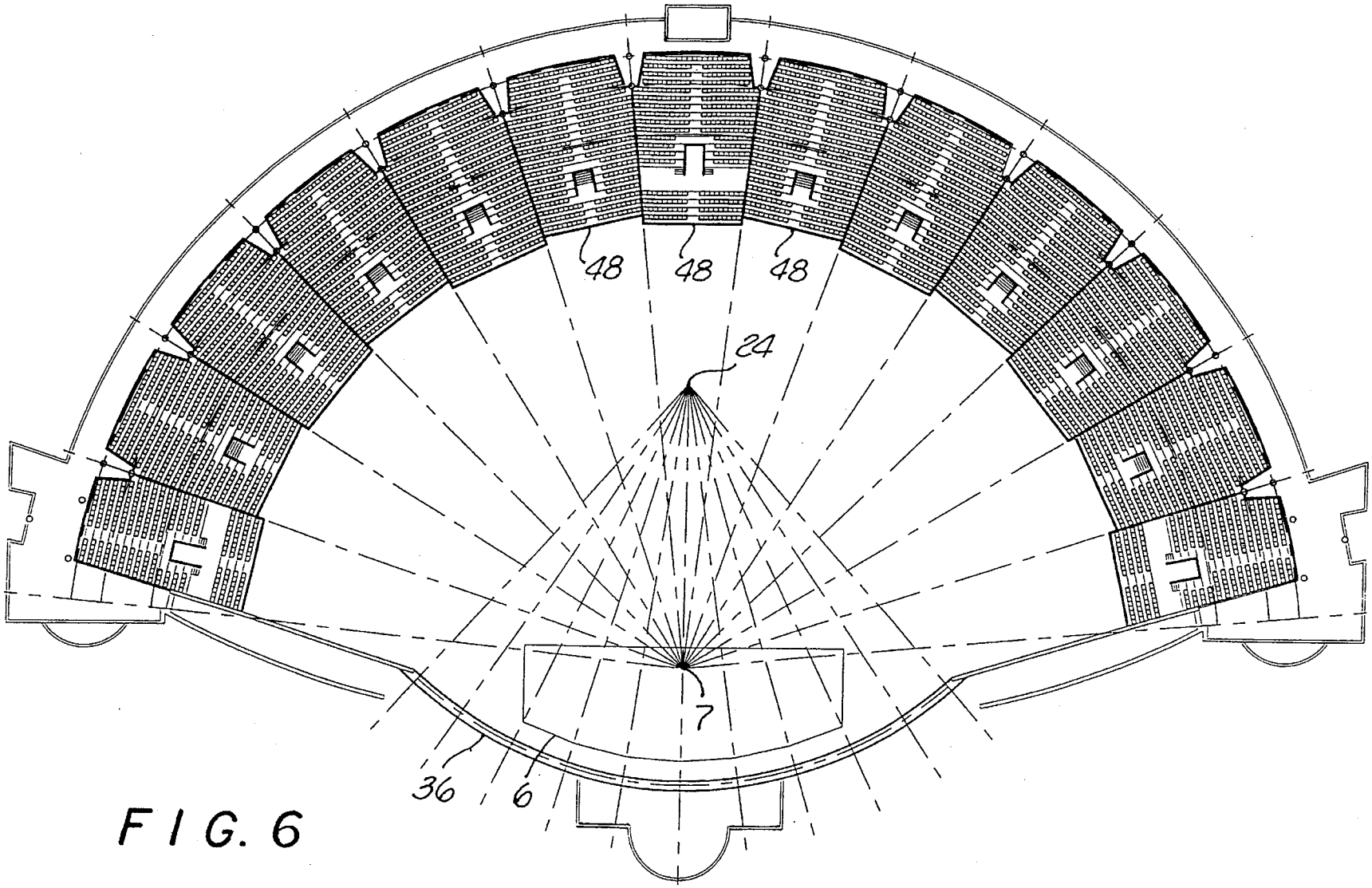
FIG. 6 is a plan view of an upper gallery seating level in the auditorium.

In order to accommodate different anticipated audience sizes, or different types of presentation, the internal configuration of the seating provided by the auditorium may be adjusted. For example, assuming total seating capacity of the auditorium as shown to be about 14000, movable partitions or curtain walls may be provided to reduce the seating capacity of the auditorium. Thus the gallery seating level may or may not be used, or circumferential partitions may be used to make available only lower portions such as 44 and 46 of the main seating level 2. Alternatively, radial partitions may be utilized to shut off wing portions of the auditorium. Advantageously, such an arrangement can be utilized to isolate central segments 48 of the gallery seating (see FIG. 6), with a screen being deployed, for example lowered and rotated from the structure 42 to a position to provide super wide screen cinema presentations.

We claim:

1. An auditorium, comprising an amphitheatre having a seating area only partially surrounding a stage, a first fixed roof structure covering a majority of the amphitheatre except for a segmental area above the stage, and second movable roof structure of segmental form movable between a first position in which it closes said segmental area, and a second position lapping the first roof structure and leaving said segmental area open, said movable roof structure comprising segmental leaves rotatable in opposite directions about a common pivotal axis between said first closed position in which the leaves abut and said second open position in which they underlay the fixed room structure, the first and second roof structures both being part-spherical shells, characterized in that the fixed roof structure is supported only at its periphery, and the movable roof structure is supported at its periphery and by a connection to the fixed roof structure on said common pivotal axis, in that a vertical axis of a first virtual sphere containing the shell forming the fixed roof structure passes through the stage, and in that a vertical axis of a second virtual sphere containing the shell forming the movable roof structure coincides with said common pivotal axis and is located horizontally spaced from the stage and passes through the seating area of the amphitheatre, intermediate between the axis of the first virtual sphere and the periphery of the fixed roof structure.

2. An auditorium according to claim 1, characterized in that a retractable curtain wall is provided behind that portion of the stage not surrounded by the seating area.

* * * * *